US006857141B1

(12) United States Patent
Jackson et al.

(10) Patent No.: US 6,857,141 B1
(45) Date of Patent: Feb. 22, 2005

(54) LAVATORY WICKER BASIN

(76) Inventors: Karen R. Jackson, 166-21st Ave. SE., St. Petersburg, FL (US) 33705; Amy J. Parsons, 166-21st Ave. SE., St. Petersburg, FL (US) 33705

( * ) Notice: Subject to any disclaimer, the term of this patent is extended or adjusted under 35 U.S.C. 154(b) by 2 days.

(21) Appl. No.: 10/671,344

(22) Filed: Sep. 25, 2003

(51) Int. Cl.[7] ..... E03C 1/14; E03C 1/32; E03C 1/33

(52) U.S. Cl. ..... 4/650; 4/619; 4/630; 4/660; 156/148; 156/293; 156/307.3; 156/307.5; 442/86; 442/253; 442/257

(58) Field of Search ..... 4/619, 630, 650, 4/660; D23/284, 285, 293.1; 442/86, 253, 257; 156/148, 293, 307.3, 307.5, 307.7

(56) References Cited

U.S. PATENT DOCUMENTS

| | | | | | |
|---|---|---|---|---|---|
| 144,563 | A | | 11/1873 | Penley | |
| 758,770 | A | | 5/1904 | McCann | |
| 1,538,016 | A | | 5/1925 | Windsor | |
| 1,703,053 | A | | 2/1929 | Belles | |
| 1,829,844 | A | | 11/1931 | Altmayer | |
| 2,147,805 | A | | 2/1939 | Windsor | |
| 3,824,636 | A | * | 7/1974 | Brown | 4/619 |
| 4,211,036 | A | | 7/1980 | Dalitz | |
| 4,844,944 | A | * | 7/1989 | Graefe et al. | 4/619 X |
| 5,087,514 | A | * | 2/1992 | Graefe | 428/315.5 |
| 5,580,621 | A | * | 12/1996 | Kuszaj et al. | 4/619 X |
| 5,683,770 | A | * | 11/1997 | Weder | 428/35.7 |
| D398,968 | S | * | 9/1998 | Wagner | D23/285 |
| D404,474 | S | * | 1/1999 | Cuttriss | D23/285 |
| D430,274 | S | | 8/2000 | Marshall | |
| D430,275 | S | | 8/2000 | Slothower | |
| D447,546 | S | * | 9/2001 | McKeone | D23/293.1 |
| 6,643,867 | B2 | * | 11/2003 | Silverman et al. | 4/630 X |
| 6,699,606 | B2 | * | 3/2004 | Machida et al. | 4/619 X |
| D488,853 | S | * | 4/2004 | Jones | D23/293.1 |

* cited by examiner

*Primary Examiner*—Gregory L. Huson
*Assistant Examiner*—Kathleen J. Prunner
(74) *Attorney, Agent, or Firm*—Larson & Larson, PA; Herbert W. Larson

(57) ABSTRACT

A multi-layered concave basin is formed for mounting in an opening in a wash stand. The basin is made from pliant woven twigs with successive bottom layers of a first clear epoxy, a clear fiber cloth and a second clear epoxy and a top layer of a third clear epoxy to create a basin impervious to water under pressure from a wash basin spigot.

20 Claims, 5 Drawing Sheets

LAVATORY WICKER BASIN

BACKGROUND OF THE INVENTION

1. Field of the Invention

The invention relates to a lavatory basin. More particularly, it refers to a multi-layered, water-tight wicker lavatory basin suitable for use in a plurality of different basin receptacles.

2. Description of the Prior Art

It is well known that wicker style articles of manufacture can not withstand the effects of water being introduced thereupon. In other words, they are not typically known for being water-tight. However, many people find them to be aesthetically pleasing and desire their use in their homes and workplaces. Of course, many people employ wicker style furniture on outdoor patios specifically because they will not retain water but instead permit water to flow freely through the piece of furniture. In fact, it is counter intuitive to think that wicker style articles of manufacture could be used in an environment where water is not meant to flow through the article.

Some attempts have been made to use wicker style articles of manufacture where water or other fluids are not meant to flow freely through the article. U.S. Pat. No. 4,211,036 describes a planter basket constructed of linear elements in a basket weave pattern with a sealing material coating the linear elements. Although this prior art wicker basket works well as a planter wherein a minimal amount of water flow can be retained, such a basket could not be used as a basin in a wash stand since it could not withstand the pressure from a water filled basin or water pressure emanating from a spigot or faucet. This prior art basket lacks the required sealant layers needed to make it water-tight such that it would be suitable for use as a lavatory basin. Nothing in this prior art basket suggests that it could be employed as a water-tight wash basin having a drain formed in a bottom portion which aligns with a reciprocal drain that leads to a sewer system.

A waterproof wicker basin and a met hod to make the same is clearly needed so that a wicker-style basin which is strong enough to withstand water pressure can be employed with a wash stand typically found in homes and work places.

SUMMARY OF THE INVENTION

We have invented a wicker-style, water-tight lavatory basin suitable for use in a wash stand. The present invention provides for a lavatory basin constructed from a wicker or similar woven structure wherein a top surface is coated with a clear unsaturated polyester resin solution, such as surf board epoxy, and a bottom surface employs multiple bottom layers providing for a leak-proof, water-tight basin. The wicker is formed to present a concave shape with a drain formed at its lowest point. The wicker is strengthened with at least two layers of epoxy clear sealant and a cloth layer sandwiched between the epoxy layers on a bottom surface. Such a strengthened basin can withstand water pressure from a filled water basin or from a wash stand spigot without leaking. The basin of the present invention can be used with a multitude of different counter-tops or wash basins such that it rests within a counter-top opening, sits upon a counter-top surface or mounts upon a pedestal.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE PREFERRED EMBODIMENT

Figure 1:
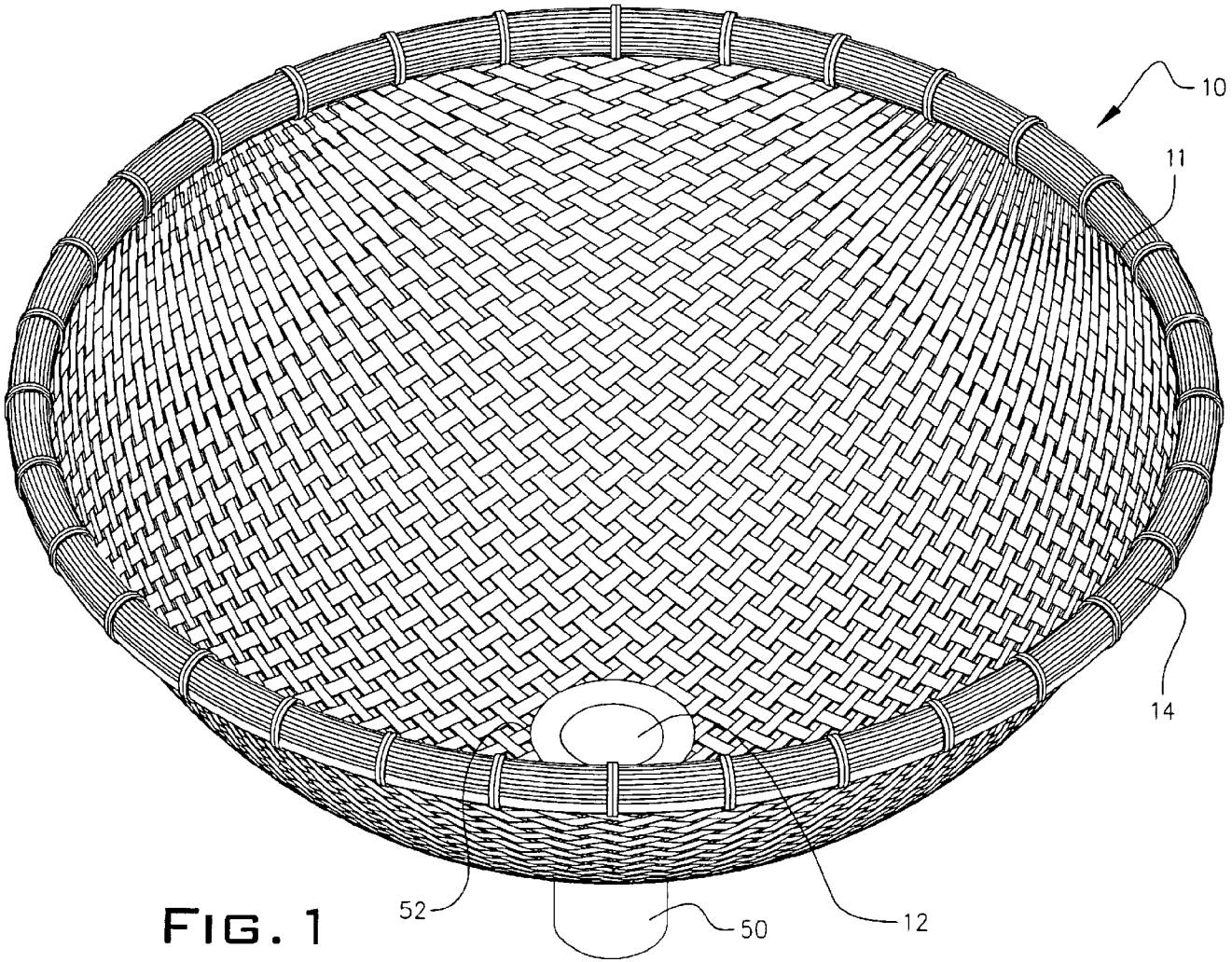
FIG. 1 is a perspective view of a lavatory wicker basin of the present invention.

Throughout the following detailed description, the same reference numerals refer to the same elements in all figures.

Referring to FIG. 1, a wicker style basin 10 of the present invention is shown having a concave configuration with a drain outlet 12 formed at a lowest point 52 and an annular edge circumference 14 disposed along an upper periphery 11. Edge 14 raises above the concave portion of basin 10. Drain outlet 12 has a pipe 50 extending downwardly from lowest point 52 which aligns with a drain pipe (not shown) to permit any water entering basin 10 to be disposed of into a sewer system.

Figure 2:
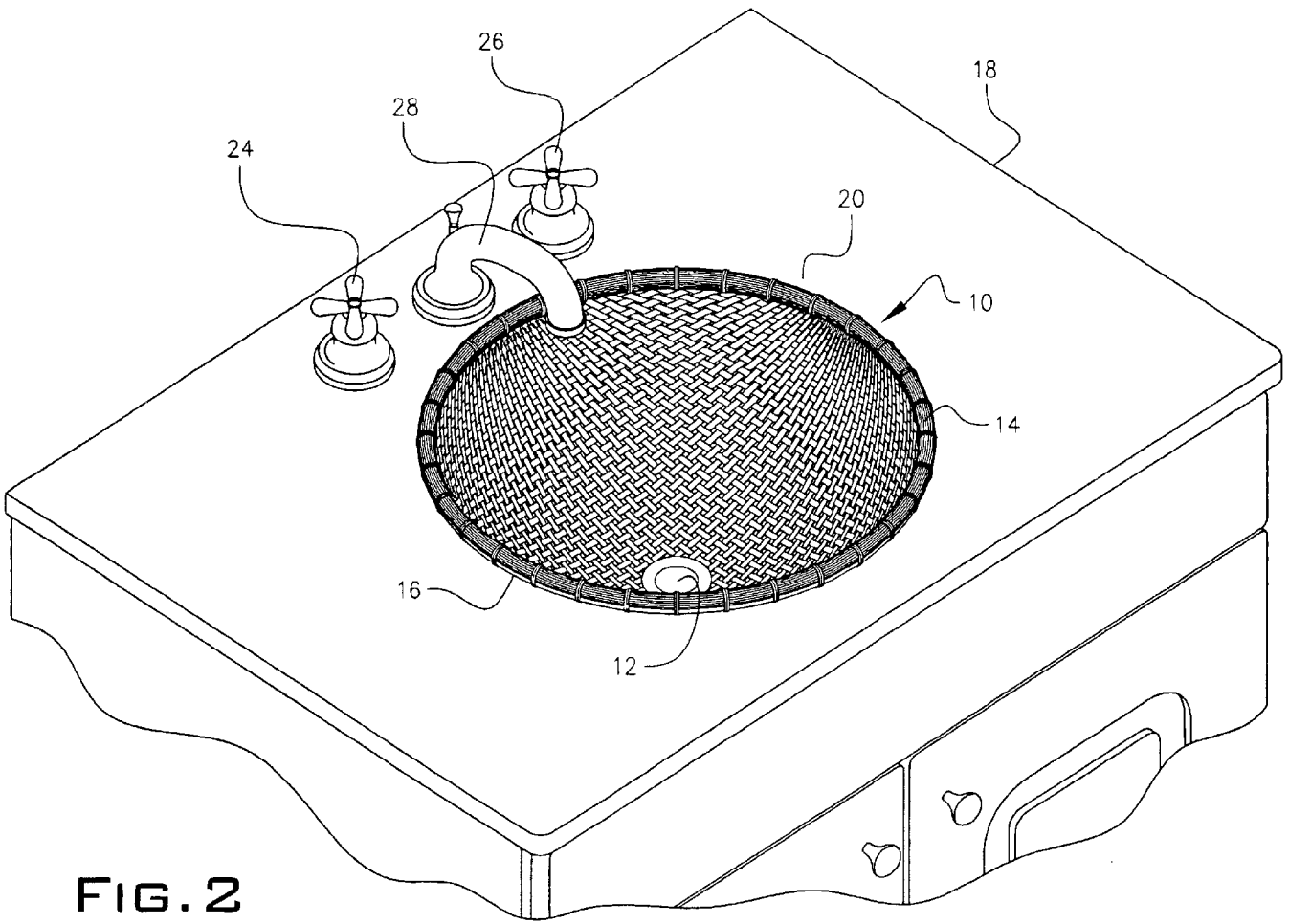
FIG. 2 is a perspective view of the lavatory wicker basin mounted in a wash stand with an upper annular edge above a top surface of the wash stand.
Figure 3:
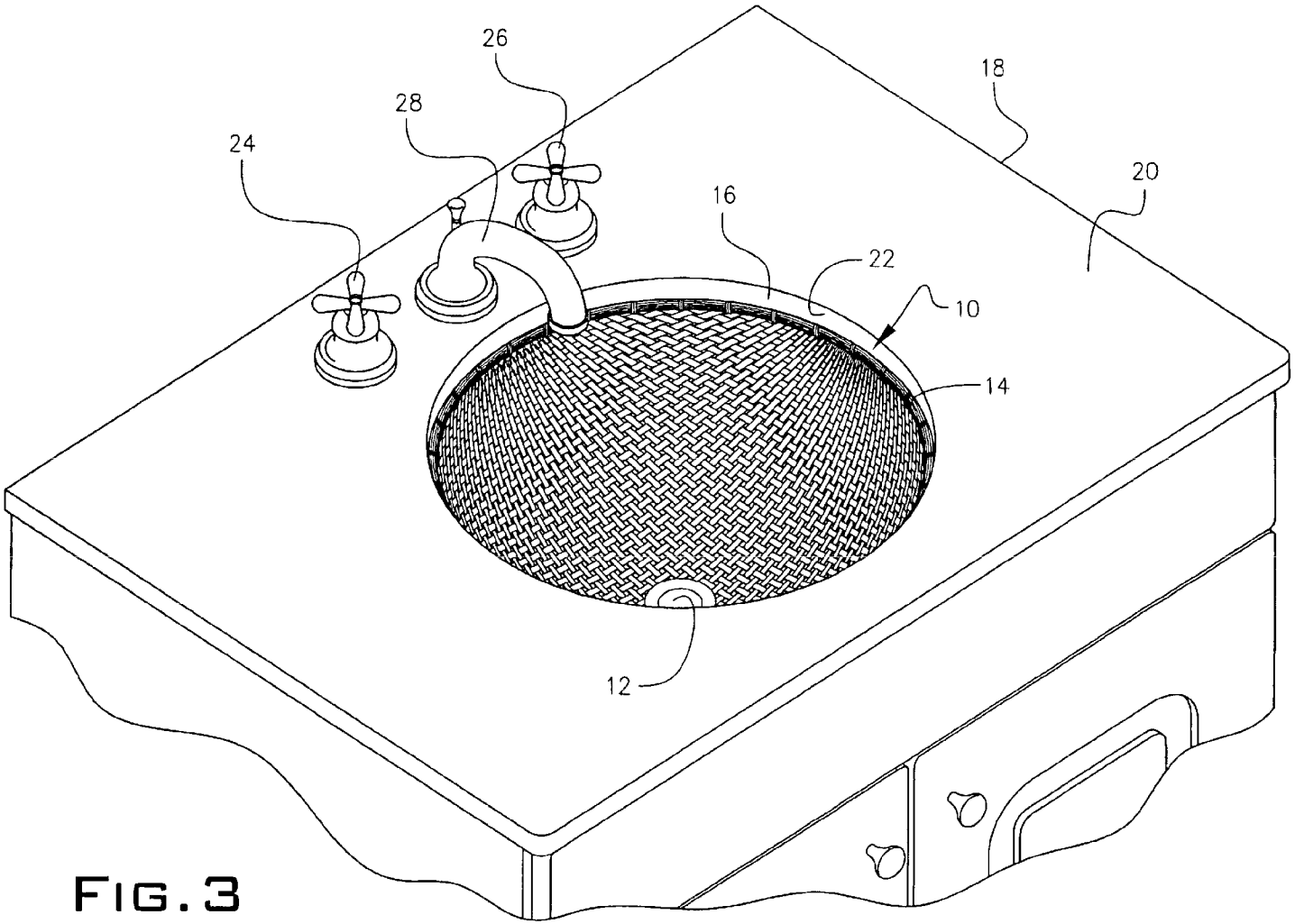
FIG. 3 is a perspective view of the lavatory wicker basin mounted within an opening in a wash basin stand but below the top surface thereof.
Figure 4:
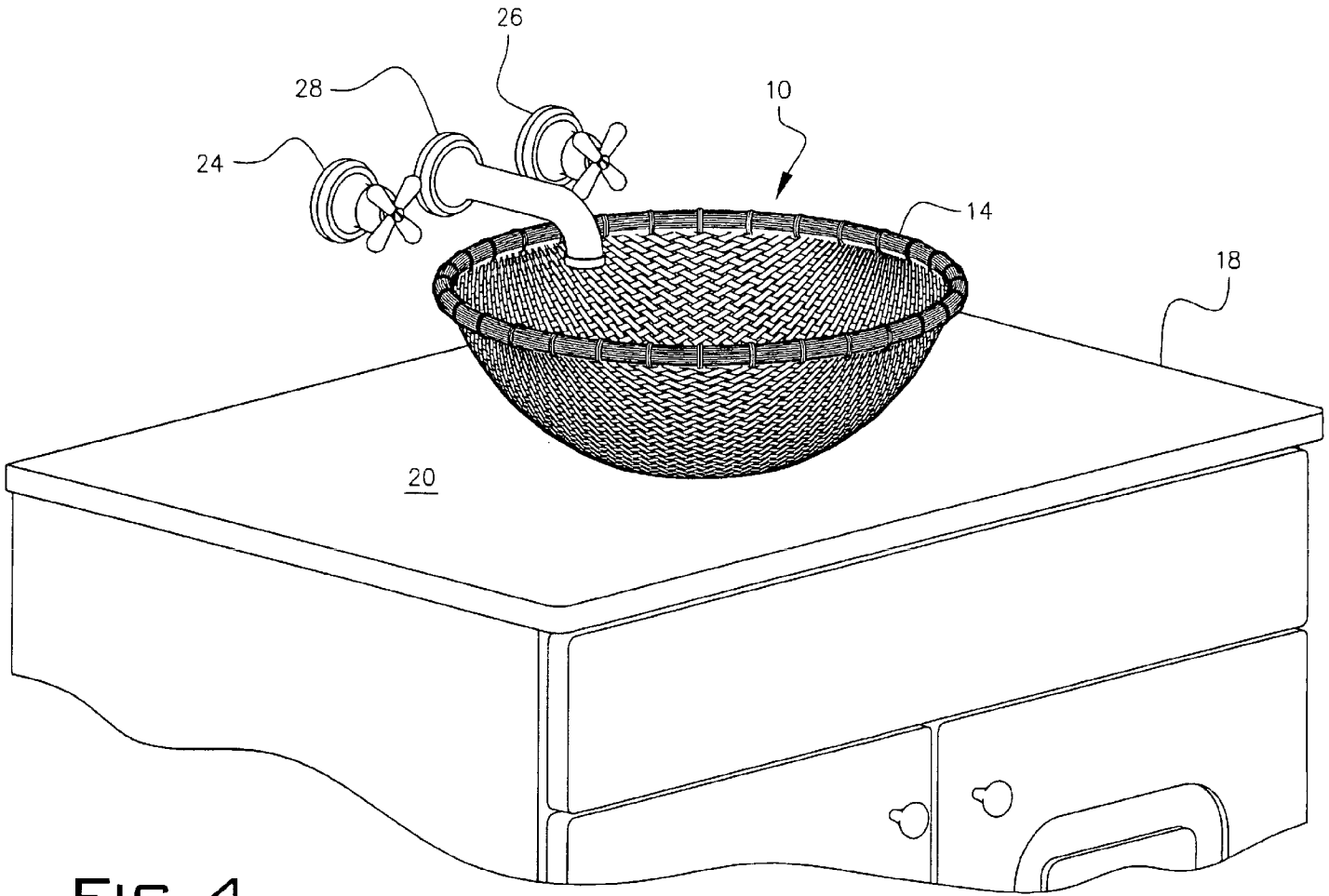
FIG. 4 is a perspective view of the lavatory wicker basin mounted on top of a wash stand or counter top.

Referring to FIG. 2, basin 10 is mounted in an opening 16 in a wash stand 18. Basin 10 can be attached to opening 16 by caulk, glue or by clips. In the preferred embodiment, edge 14 rests upon top surface 20 of wash stand 18. However, as shown in FIG. 3, edge 14 can be disposed with respect to vertical wall 22 of opening 16 such that edge 14 is slightly below wash stand top surface 20. The basin 10 rests on a horizontal support below opening 16. Still further, as shown in FIG. 4, basin 10 can be positioned completely above wash stand top surface 20 such that the entire concave shape of basin 10 rests outside of wash stand 18. Of course, in this alternate embodiment (FIG. 4), opening 16 is not needed. Although not shown in FIG. 4, pipe 50 fits within a small aperture which again aligns with a drain pipe permitting any water that enters basin 10 to be expelled into the sewer system.

Another alternate embodiment, although not shown, employs a pedestal type wash stand which can receive basin 10 in any of the same manners as described above for a traditional style wash stand as shown in FIGS. 2–4. Regardless of the style of wash stand employed (counter-top or pedestal) and regardless of how basin 10 is mounted, each configuration employs a hot 24 and cold 26 water handle and a spigot 28 for delivery of water to basin 10, as shown in FIGS. 2–4.

Figure 5:
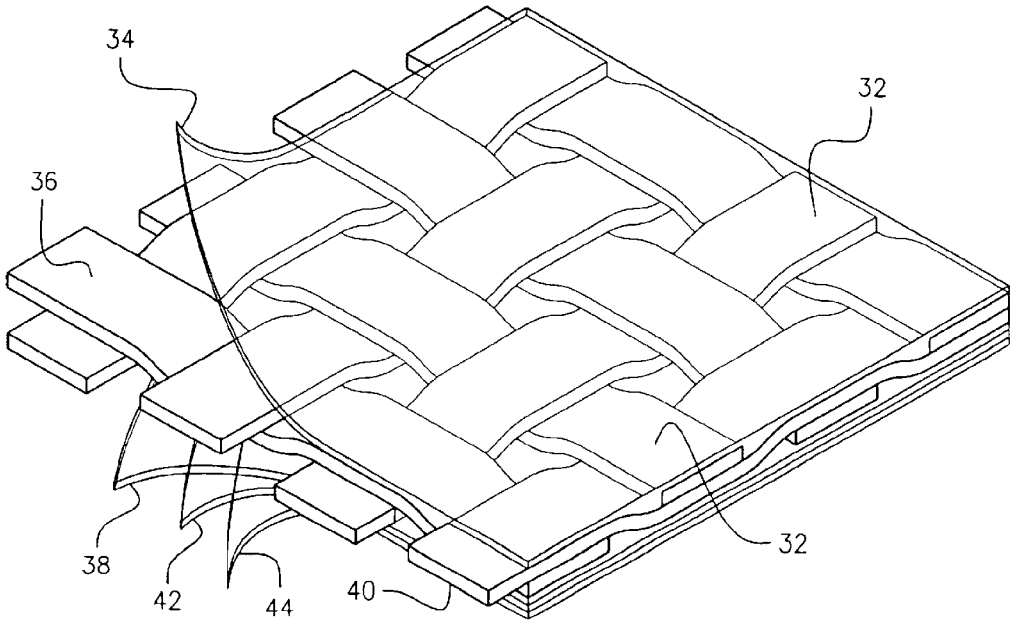
FIG. 5 is a cross-sectional view of the preferred lavatory wicker basin illustrating multiple layers employed therein.

Wicker is a slender pliant twig 32 that is woven together and shaped to form the basin 10 as seen in FIG. 5 for the preferred embodiment. It is understood however that basin 10 is not limited to being constructed from wicker. Other pliant type twigs or slivers of wood, such as osier or withe, can be employed to achieve the same result. Further, nothing herein limits the use of synthetically made material that has the same pliability of wicker. Even further, a non pliable synthetically made material could be employed through injected molding which would give the same appearance of wicker.

Referring again to FIG. 5, in a preferred embodiment for basin 10, a first layer of clear surf board epoxy 38 is applied over a bottom surface 40 of the woven twigs 32. The surf board epoxy 38 is allowed to become tacky. A fabric cloth 42 (having been pre-soaked in surf board epoxy before being applied) is then applied over the first layer of clear epoxy 38. The fabric cloth is allowed to set. Next, a second layer of clear surf board epoxy 44 is applied over the hardened cloth 42. Other layers of epoxy can be added as desired. Lastly, one or more layers of clear epoxy 34 is applied to a top surface 36 of the woven twigs 32. These layers are 1.8 to 2.6 mm thick. It is understood that each clear epoxy layer described can actually represent the application of multiple layers being applied. For instance, as one example, the application of layer 34 to the inside portion (top surface 36) of basin 10 can actually represent eight to ten coats being applied to form layer 34. Further, different configurations can be employed wherein fiber cloth 42 is only used on bottom surface 40, only on top surface 36 or used on both top and bottom surface 36 and 40, respectively. In a preferred embodiment, fiber cloth 42 is six to 8 ounce fiberglass. Further, the layers can be painted on with a brush, or basin 10 be dipped repeatedly to apply each layer. Of course, fiber cloth 42, acting as a reinforcement layer, is most accurately applied by hand. As an example of an alternative embodiment, FIG. 6 is shown wherein additional layers of epoxy; namely, layer 46 and layer 48 are applied.

The clear epoxy employed in this invention can be clear coat two-part epoxy. It is preferably applied in layers to achieve a thickness of 0.5 to 3.0 mm thick such that all openings in between the pliant twigs are completely filled. The clear fiber cloth 42 is fiberglass preferably applied saturated with the two part epoxy.

Figure 6:
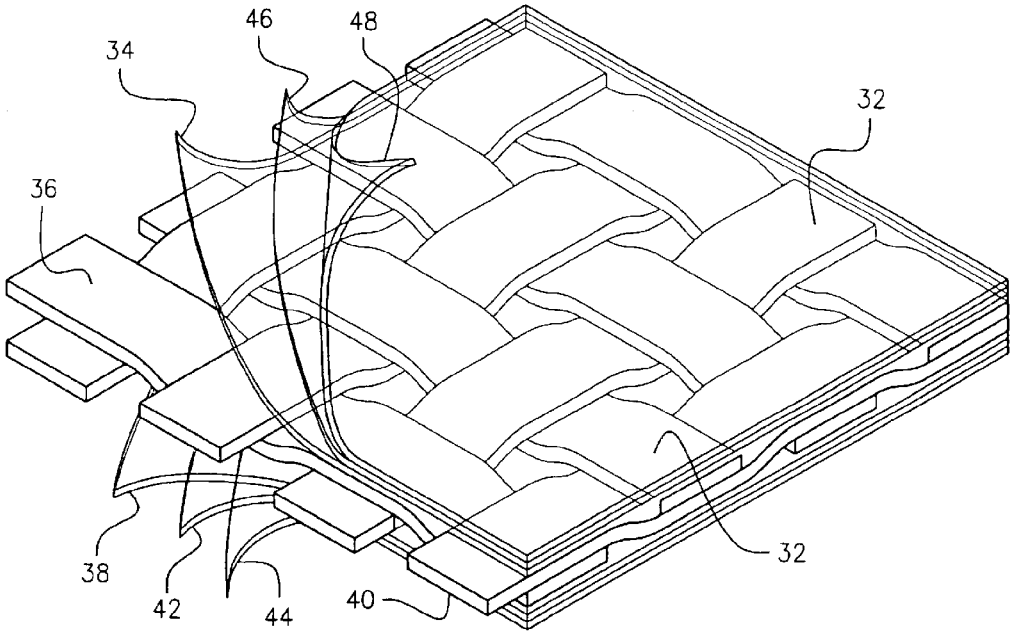
FIG. 6 is a cross-sectional view of an alternate lavatory wicker basin illustrating multiple layers employed therein.

The description of basin 10, as shown in FIGS. 5 and 6, discloses that the various layers are applied on the top and bottom surfaces, 36 and 40, respectively. The present invention also includes a method of making basin 10. The preferred method employs the following steps. First, a concave-shaped wicker basin is provided. Next, a first layer of epoxy is applied to basin bottom surface 40. The epoxy is allowed to become tacky. Thereafter, a pre-soaked in epoxy fiber cloth layer is applied over the first set layer of epoxy. Next, additional layers of epoxy are applied over the hardened fiber cloth layer to a thickness of 0.5 to 3.0 mm. Then, multiple layers of epoxy, to a thickness of 0.5 to 3.0 mm, are applied to the basin top surface 36 (or inner surface). An opening is then cut through the wicker and epoxy layers at the lowest point within the basin inner surface (top surface 36) so that a drain pipe and collar can be inserted therethrough. Finally, the basin is attached to a wash stand and its associated plumbing.

The preferred clear epoxy sealant layer employed is a two component mix at a ratio of one pint of unsaturated polyester resin solution to 5 cc of a methyl ethyl ketone peroxide activator. It is commonly called surf board epoxy.

Equivalent elements can be substituted for the ones set forth above such that they perform in the same manner in the same way for achieving the same result. Further, equivalent steps can be substituted for the ones set forth above such that they perform in the same manner in the same way for achieving the same result.

What is claimed is:

1. A lavatory basin adapted to be impervious to water pressure coming from a wash stand spigot, and the weight of water in a full basin, the basin comprising:

a) a concave-shaped bowl formed from pliable interwoven members, the bowl having a top and bottom surface, an upper annular peripheral edge and an opening formed in a lower portion;

b) a first sealant layer coating the bowl bottom surface, the first sealant layer having a bottom surface;

c) a fibrous cloth having a top and bottom surface, the fibrous cloth top surface adhered to the first sealant layer bottom surface;

d) a second sealant layer coating the fibrous cloth bottom surface; and e) a third sealant layer coating the bowl top surface.

2. The basin of claim 1, further comprising a cylindrically shaped drain pipe inserted through the opening formed in the bowl lower portion, the drain pipe including an annular collar disposed at a top end for fitting around the bowl lower portion opening and a downwardly extending tubular portion for aligning with a sewer drain.

3. The basin of claim 2, further comprising a fourth sealant layer applied to a top surface of the third sealant layer for creating a water-tight seal for the drain pipe inserted through the bowl lower portion opening.

4. The basin of claim 2, wherein the bowl is positioned upon a top surface of a wash stand, the wash stand having an opening for receiving the basin drain pipe.

5. The basin of claim 1, wherein the basin concave-shaped bowl pliable interwoven members are wicker.

6. The basin of claim 1, further comprising an annular edge disposed along the bowl upper peripheral.

7. The basin of claim 6, wherein the bowl is positioned within an opening of a wash stand having a top surface, the bowl upper peripheral annular edge disposed above the wash stand upper surface.

8. The basin of claim 6, wherein the bowl is positioned within an opening of a wash stand having a top surface, the bowl upper peripheral annular edge disposed below the wash stand upper surface.

9. The basin of claim 1, wherein the bowl is positioned within an opening of a wash stand.

10. The basin of claim 1, wherein the first, second and third sealant layers each comprise at least one coat of clear epoxy.

11. The basin of claim 1, wherein the fibrous cloth is fiberglass.

12. The basin of claim 1, further comprising:

a) a second fibrous cloth having a top and bottom surface, the second fibrous cloth bottom surface adhered to a top surface of the third sealant layer; and b) a top sealant layer coating the second fibrous cloth top surface.

13. A lavatory basin adapted to be impervious to water pressure coming from a wash stand spigot, the basin comprising:

a) a concave-shaped wicker bowl having a top and bottom surface, an upper annular peripheral edge and an opening formed in a lower portion;

b) a first sealant layer comprising at least one coating applied to the bowl bottom surface, the first sealant layer having a bottom surface;

c) a fibrous cloth having a top and bottom surface, the fibrous cloth top surface adhered to the first sealant layer bottom surface;

d) a second sealant layer comprising at least one coating applied to the fibrous cloth bottom surface;

e) a third sealant layer comprising at least one coating applied to the bowl top surface; and f) a cylindrically shaped drain pipe inserted through the opening formed in the bowl lower portion, the drain pipe including an annular collar disposed at a top end for fitting around the bowl lower portion opening and a downwardly extending tubular portion for aligning with a sewer drain.

14. The basin of claim 13, further comprising a fourth sealant layer applied to a top surface of the third sealant layer for creating a water-tight seal for the drain pipe inserted through the bowl lower portion opening.

15. The basin of claim 13, further comprising a thickness of the sealant layers on the bowl top and bottom surface of 0.5 to 3.0 mm.

16. The basin of claim 13, further comprising:

a) a second fibrous cloth having a top and bottom surface, the second fibrous cloth bottom surface adhered to a top surface of the third sealant layer; and b) a top sealant layer coating the second fibrous cloth top surface.

17. A method for making a water impervious lavatory basin, the steps of the method comprising:

a) providing a concave-shaped bowl constructed from pliable interwoven members, the bowl having a top and bottom surface and an opening formed in a lower point of the bowl;

b) applying a first sealant layer to the bowl bottom surface, the first sealant layer having a bottom surface;

c) permitting the first sealant layer to become tacky;

d) applying a fibrous cloth layer soaked in a wet curable sealant to the first sealant layer bottom surface, the fibrous cloth layer having a bottom surface;

e) applying additional layers to the fibrous cloth bottom surface after it has hardened;

f) permitting the additional sealant layers to cure;

g) applying sealant layers to the bowl top surface; and f) permitting the sealant layers applied to the bowl top surface to cure.

18. The method of claim 17, further comprising the steps of:

a) inserting a drain pipe through the bowl opening cut in the lower portion, the drain pipe including an annular collar disposed at a top end for fitting around the bowl lower portion opening and a downwardly extending tubular portion for aligning with a sewer drain;

b) applying an additional sealant layer for creating a water-tight seal around the drain pipe collar; and c) permitting the additional sealant layer to cure.

19. The method of claim 17, wherein the pliable interwoven members are wicker.

20. The method of claim 17, wherein the steps of applying the sealant layers employs brushing, dipping or spraying.

* * * * *